United States Patent [19]

Terrill

[11] Patent Number: 4,876,815

[45] Date of Patent: Oct. 31, 1989

[54] SIGHT MOUNTING PLATFORM FOR COLT M-16/AR-15 RIFLE

[76] Inventor: Rufus O. Terrill, 1793 Saxon Pl., NE., Atlanta, Ga. 30319

[21] Appl. No.: 315,558

[22] Filed: Feb. 24, 1989

[51] Int. Cl.[4] ..... F41G 1/38

[52] U.S. Cl. ..... 42/100; 42/101; 33/233; 33/245

[58] Field of Search ..... 42/100–103; 33/233, 245, 250

[56] References Cited

U.S. PATENT DOCUMENTS

| | | | |
|---|---|---|---|
| 2,775,166 | 12/1956 | Janson | 42/101 |
| 3,568,324 | 3/1971 | Jorczak | 42/100 |
| 3,824,699 | 7/1974 | Lenz et al. | 42/103 |
| 4,291,478 | 9/1981 | Lough | 42/103 |
| 4,291,479 | 9/1981 | Lough | 42/103 |

FOREIGN PATENT DOCUMENTS

| | | | |
|---|---|---|---|
| 2052025 | 1/1981 | United Kingdom | 42/100 |

*Primary Examiner*—Deborah L. Kyle

*Assistant Examiner*—Michael J. Carone

[57] ABSTRACT

A sight mounting platform consisting of a flat, smooth sight attachment area(1), a mounting spline(2) and a backing plate(6) which attaches to the top carrying handle(9) of the Colt M-16/AR-15 rifle and is held in place by the compressive force of the backing plate(6) being bolted(8) to the face of the mounting spline(3) with the carrying handle sandwiched in between. All axial, lateral and rotational movement is prevented by the contour shape of the mounting spline(2) and the compressive force exerted on the top carrying handle(9) by the backing plate(6) and face of the SMP(4). A secondary screw(5) is also used if extra support is needed. The secondary screw(5) is inserted through the existing hole in the top of the carrying handle(9) and threaded into the top of the mounting spline(2). The sight mounting platform is made of a light machineable, castable material such as aluminum or plastic. The sight mounting platform can be quickly and easily detached from or reattached to the weapon with no movement of the weapon's zero sighting point.

2 Claims, 5 Drawing Sheets

SIGHT MOUNTING PLATFORM FOR COLT M-16/AR-15 RIFLE

SUMMARY OF INVENTION

The object of this invention is to provide a very stable platform on which sighting apparatus may be attached to the top carrying handle of the Colt M-16/AR-15 rifle. The platform is designed to be attached to the weapon in a manner which does not require modification of the weapon before or after attachment of the sight mounting platform.

Sighting apparatus mounted to the sight mounting platform are held to the side of and parallel to the weapon's standard sights so the sight picture produced by the front sight blade and the rear sight aperture is not altered by devices attached to the sight mounting platform. Therefore, the weapon's standard sights are always available for use, when needed.

DETAILED DESCRIPTION

Figure 1:
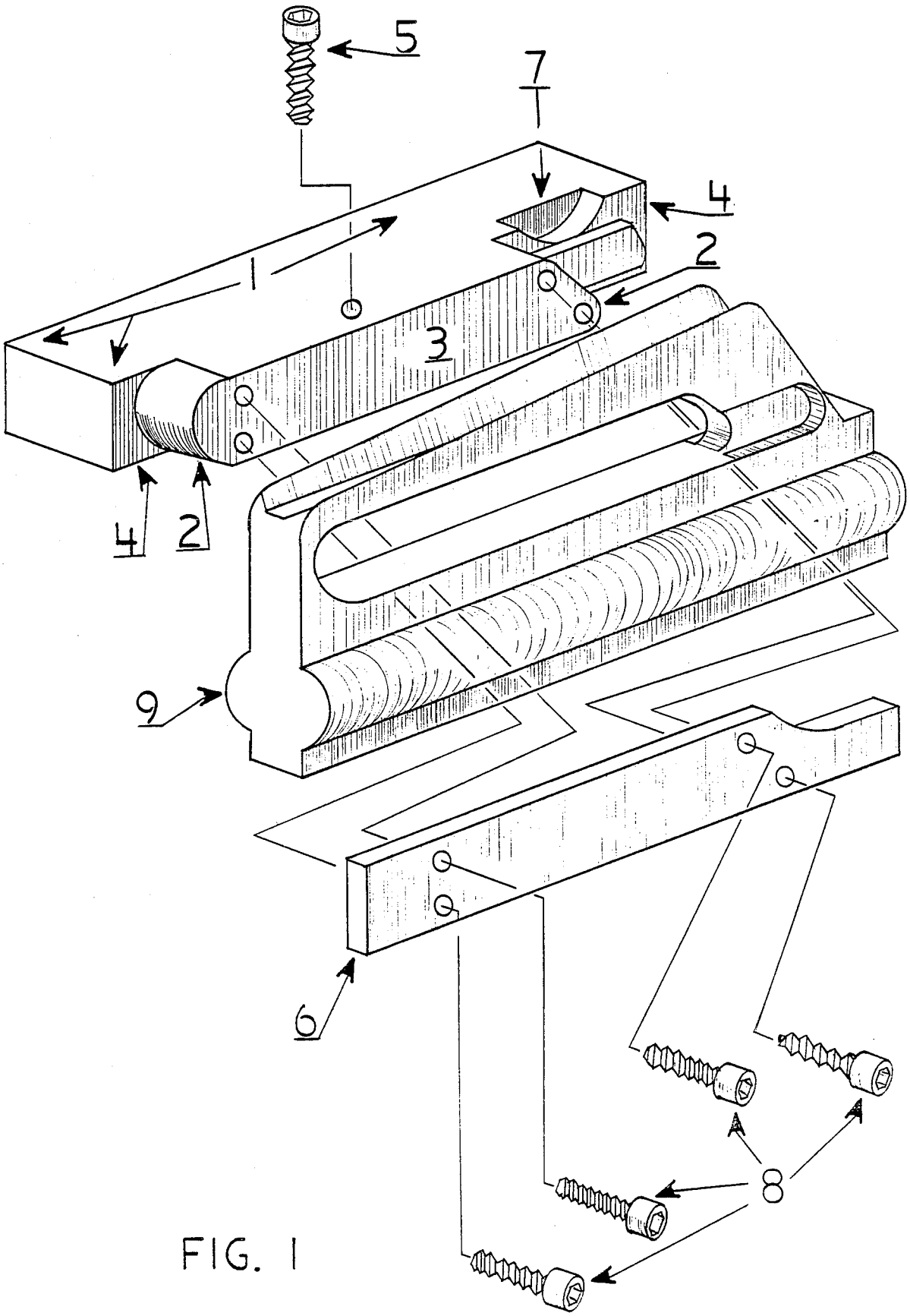
FIG. 1 is an exploded view of the Sight Mounting Platform (SMP) and the backing plate in relation to the top carrying handle of the M-16/AR-15 rifle.
Figure 2:
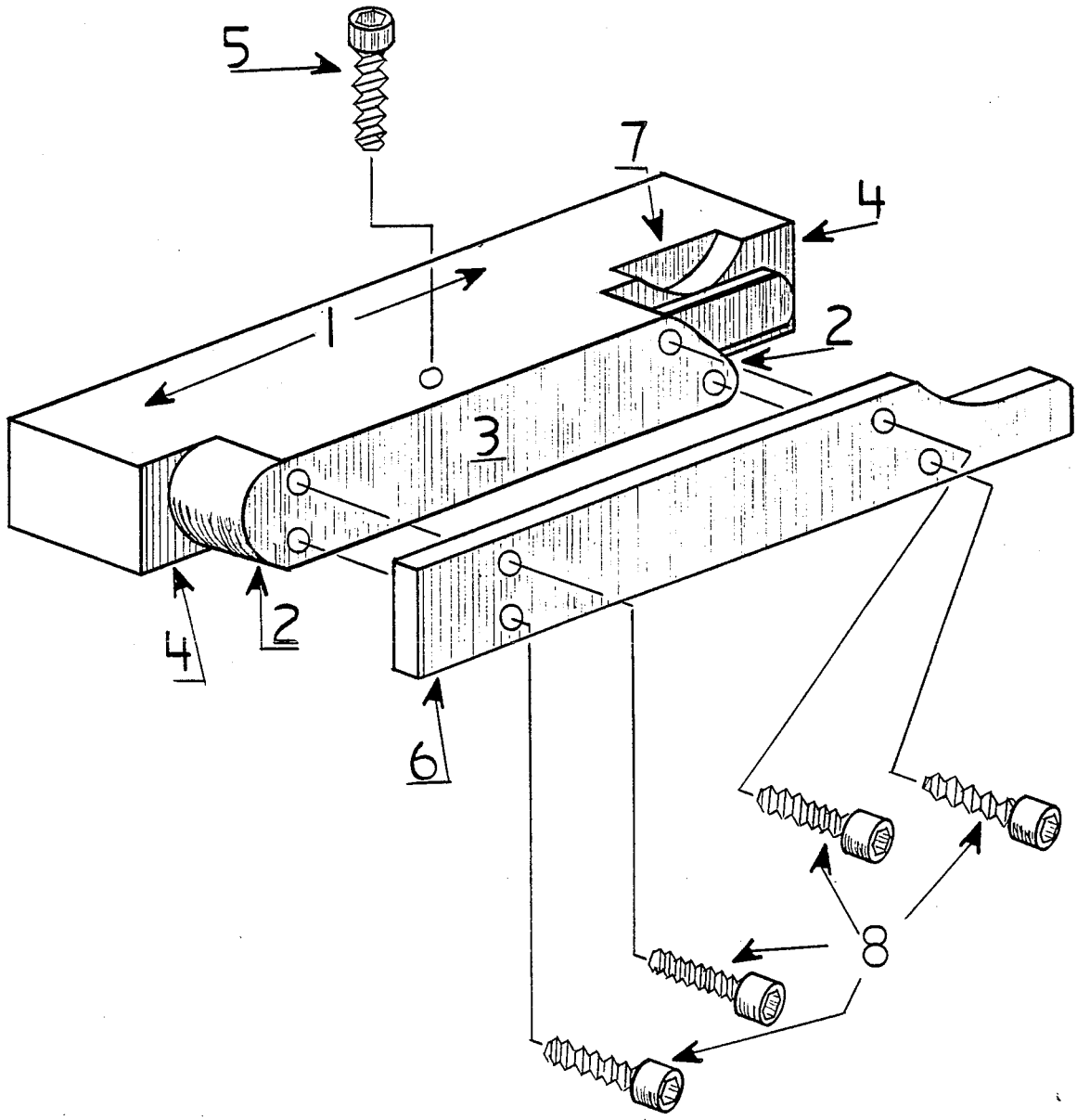
FIG. 2 is an exploded view showing the sight mounting platform along with the backing plate and attachment screws.
Figure 3:
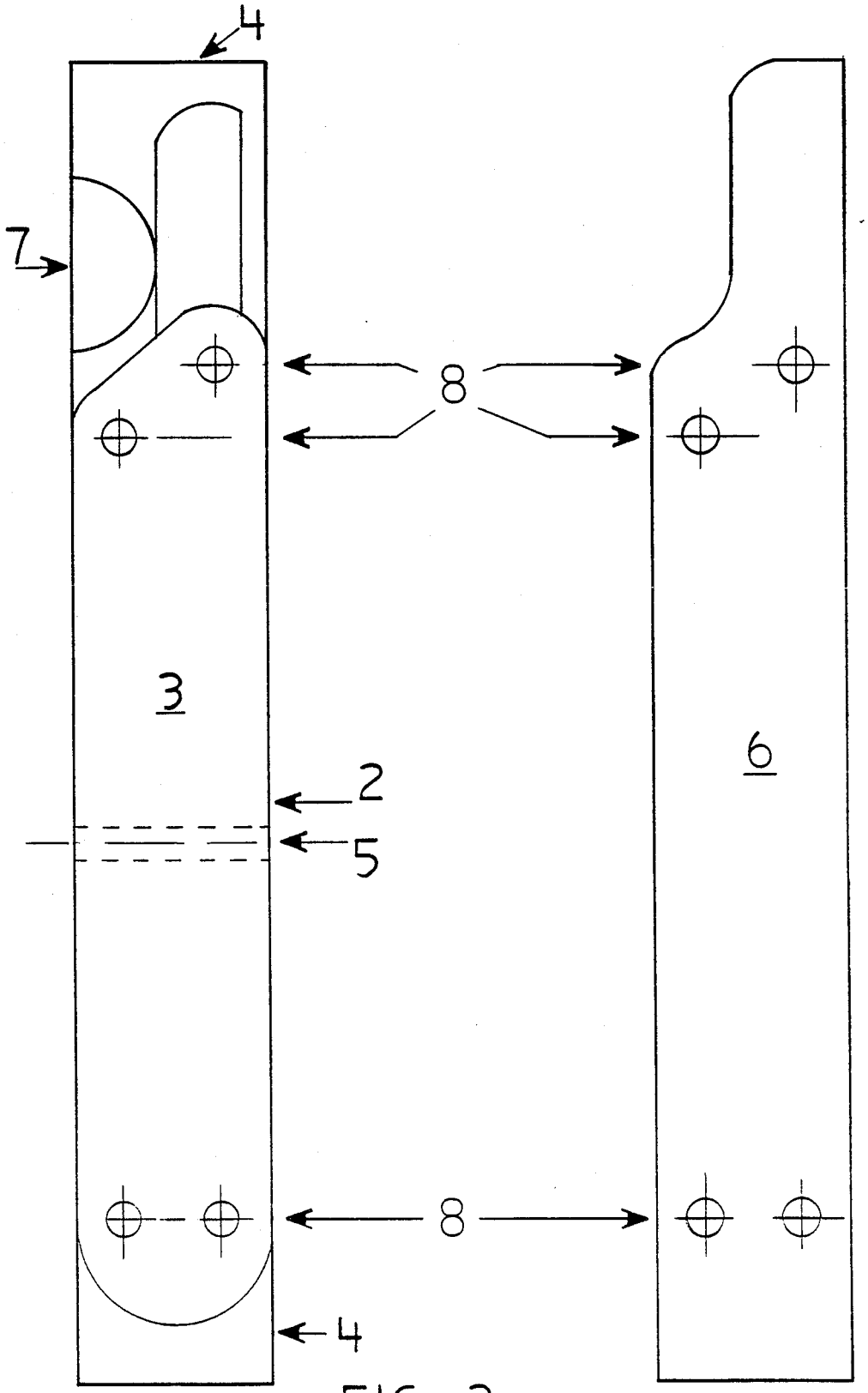
FIG. 3 is a side elevation view showing the profiles of the backing plate (6), the mounting spline face (3), the face of the SMP (4), and the machined notch (7).
Figure 4:
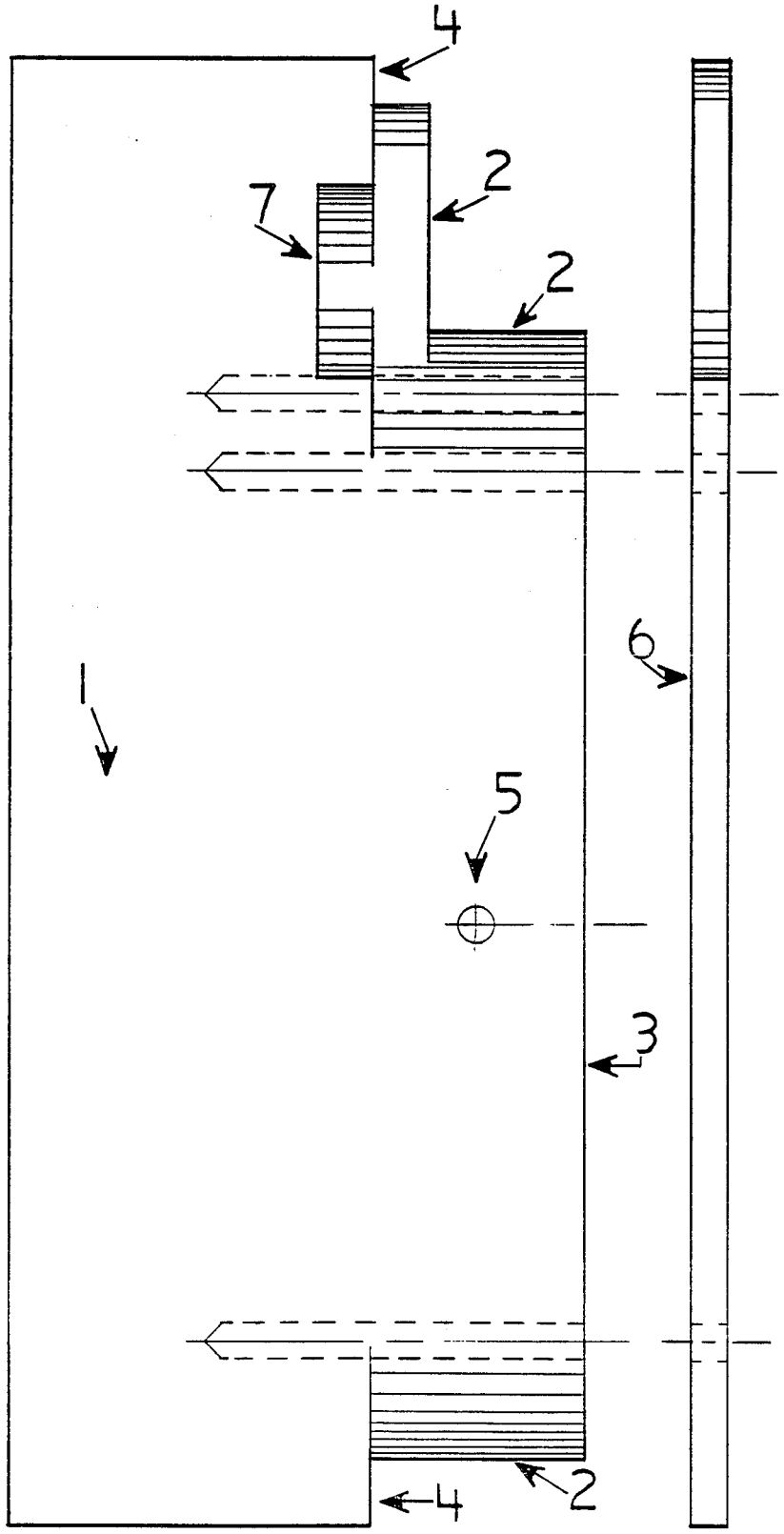
FIG. 4 is a top plan view of the mounting platform and the backing plate.
Figure 5:
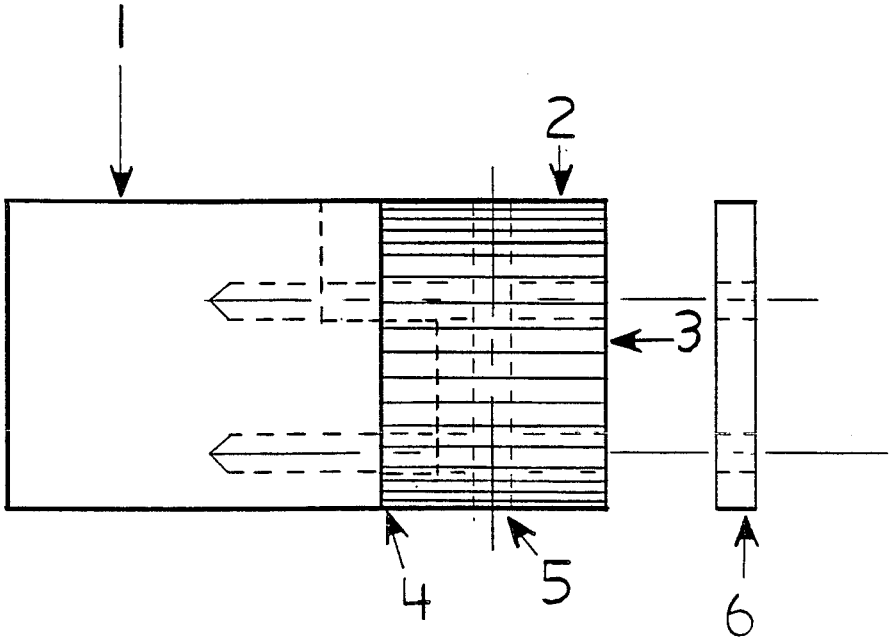
FIG. 5 is a front elevational view showing the sight mounting platform and backing plate.

The mounting spline (2) of the Sight Mounting Platform (SMP) is inserted into the opening of the top carrying handle (9). The face of the SMP (4) at the base of the mounting spline (2) rest against the outside of the carrying handle (9). The machined notch (7) at the rear of the SMP allows free adjustment of the rifle's standard windage knob.

The backing plate (6) is placed against the outside of the carrying handle across from and parallel to the SMP.

Attachment screws (8) are inserted into the backing plate (6) and then into the face of the mounting spline (3).

The compressive force acting on the top carrying handle between the back of the backing plate (6) and the face of the SMP (4) at the base of the mounting spline (2) holds the SMP securely in place.

For extra support a secondary attachment screw is used. The secondary screw (5) is inserted through the existing hole in the top of the carrying handle (9) and threaded into the top of the mounting spline (2).

Sighting apparatus, which are to be mounted on the SMP, can be mounted at any point on the sight attachment area (1).

I claim:

1. A sight mounting plate for use with a firearm having a carrying handle defining an elongated opening having an inner contoured surface which provides access of the operator's hand to facilitate carrying the weapon and a mounting hole extending through the top of the carrying handle to the opening; the sight mounting plate comprising:

an elongated first plate portion having a side surface which exceeds the elongated length of the handle opening;

an elongated second plate portion integral with the side surface of the first plate portion and shaped to completely match the inner contoured surface of the handle opening and having at least two blind side apertures in a side surface thereof and one blind top aperture on a top surface thereof; the top aperture located such that it is aligned with the mounting hole in the handle when the elongated second plate portion is inserted in the handle opening; and a separate third plate portion having substantially the same length as the first plate side surface and including at least two apertures located to coincide with the at least two blind side apertures of the second plate portion;

wherein the second plate portion is inserted in the opening of the handle with the side surface of the first plate abutting a first side surface of the handle and fastened thereto via the mounting hole and the top aperture, and the third plate is abutted against an opposite side surface of the handle and is mounted to the second plate via the at least two apertures in the second and third plates.

2. The sight mounting plate as defined in claim 1 further comprising a recess located in the side surface of the first plate portion for allowing access and adjustment to a windage adjustment knob located on the handle.

* * * * *